US011067241B2

(12) United States Patent
Bhakta

(10) Patent No.: US 11,067,241 B2
(45) Date of Patent: Jul. 20, 2021

(54) METHODS AND APPARATUS FOR INTRINSICALLY SAFE LASER SOURCED ILLUMINATION

(71) Applicant: Texas Instruments Incorporated, Dallas, TX (US)

(72) Inventor: Vikrant R. Bhakta, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 170 days.

(21) Appl. No.: 14/925,328

(22) Filed: Oct. 28, 2015

(65) Prior Publication Data

US 2017/0122515 A1 May 4, 2017

(51) Int. Cl.
*F21S 41/125* (2018.01)
*F21S 41/37* (2018.01)
(Continued)

(52) U.S. Cl.
CPC ..... *F21S 41/125* (2018.01); *F21S 41/13* (2018.01); *F21S 41/16* (2018.01); *F21S 41/176* (2018.01);
(Continued)

(58) Field of Classification Search
CPC ..... F21S 48/1136; F21V 7/22; F21V 9/20; F21V 9/00; F21V 9/30; F21V 9/35;
(Continued)

(56) References Cited

U.S. PATENT DOCUMENTS 6,883,947 B1 4/2005 Sarabia
2005/0265411 A1 12/2005 Takeuchi et al.
(Continued)

FOREIGN PATENT DOCUMENTS

CN 104035266 A 9/2014
JP 2014232734 A 12/2014
(Continued)

OTHER PUBLICATIONS

Azooptics, https://www.azooptics.com/Article.aspx?ArticleID=554 (Year: 2013).*
(Continued)

*Primary Examiner* — Jong-Suk (James) Lee
*Assistant Examiner* — James M Endo
(74) *Attorney, Agent, or Firm* — Michelle F. Murray; Charles A. Brill; Frank D. Cimino

(57) ABSTRACT

Intrinsically safe laser sourced illumination. A system for illumination is disclosed, including a plurality of laser illumination sources configured to transmit laser beams; a dichroic mirror spaced from the plurality of laser illumination sources and having an aperture configured to allow the laser beams to pass through the dichroic mirror, the remaining surfaces of the dichroic mirror configured to reflect the laser beams; a phosphor element spaced from the dichroic mirror and coated with a substance to fluoresce when struck by the laser beams and configured to disperse the laser beams and to output combined light that includes fluorescent light and the dispersed laser beams; and an illumination output arranged to receive the combined light from the phosphor element and to output illuminating light containing both the fluorescent light and the dispersed laser beams. Methods are also disclosed.

20 Claims, 11 Drawing Sheets

(51) Int. Cl.

| | |
|---|---|
| ***F21S 41/20*** | (2018.01) |
| ***F21S 41/32*** | (2018.01) |
| ***F21S 41/16*** | (2018.01) |
| ***F21S 45/70*** | (2018.01) |
| ***F21S 41/176*** | (2018.01) |
| ***F21S 41/13*** | (2018.01) |
| ***F21S 41/43*** | (2018.01) |

(52) U.S. Cl.
CPC ..... *F21S 41/285* (2018.01); *F21S 41/321* (2018.01); *F21S 41/37* (2018.01); *F21S 41/43* (2018.01); *F21S 45/70* (2018.01)

(58) Field of Classification Search
CPC ... F21V 13/14; F21V 7/26; F21V 7/30; F21V 9/32; F21V 7/0025; F21V 7/28; F21V 13/04; F21V 13/045; G02B 2027/0114; G02B 27/141; G02B 21/0076; G02B 2207/113; G02B 6/29361; G03B 33/12; G03B 21/204; G03B 21/2033; G03B 21/2066; G03B 21/28; F21K 9/64
USPC ..... 362/343, 346, 84
See application file for complete search history.

(56) References Cited

U.S. PATENT DOCUMENTS

2011/0043762 A1* 2/2011 Miyamae ..... G03B 21/14 353/20
2011/0249436 A1* 10/2011 Li ..... H04N 9/315 362/235
2012/0268917 A1* 10/2012 Kitano ..... H04N 9/3105 362/84
2012/0316397 A1* 12/2012 Berben ..... A61B 18/22 600/182
2013/0038847 A1* 2/2013 Katou ..... G02B 5/26 353/98
2013/0100644 A1* 4/2013 Hu ..... F21V 7/22 362/84
2013/0194551 A1* 8/2013 Zhang ..... F21V 9/00 353/31
2013/0250248 A1* 9/2013 Ogura ..... G03B 21/204 353/31
2013/0250253 A1* 9/2013 Ogura ..... F21V 13/08 353/85
2013/0250546 A1* 9/2013 Hu ..... F21V 9/08 362/84
2013/0314893 A1* 11/2013 Paquette ..... G02F 1/353 362/84
2014/0029237 A1* 1/2014 Mehl ..... F21V 9/08 362/84
2014/0055754 A1* 2/2014 Chuang ..... G03B 21/005 353/20
2014/0160441 A1* 6/2014 Kim ..... G03B 33/08 353/33
2014/0254129 A1* 9/2014 Miyoshi ..... F21V 13/08 362/84
2014/0254130 A1* 9/2014 Mehl ..... G03B 21/204 362/84
2014/0285774 A1* 9/2014 Tajiri ..... G03B 21/28 353/38
2014/0306878 A1 10/2014 Bhakta
2014/0376205 A1* 12/2014 Takizawa ..... H01S 5/005 362/84
2015/0062903 A1* 3/2015 Hu ..... G03B 21/204 362/259
2015/0077973 A1 3/2015 Hagemann et al.

FOREIGN PATENT DOCUMENTS

WO 2009040725 A2 4/2009
WO WO-2013136732 A1 * 9/2013 ..... C09K 11/7739

OTHER PUBLICATIONS

Olympus, https://www.olympus-lifescience.com/en/microscope-resource/primer/java/filters/interference/.*
Udel, http://www1.udel.edu/chem/sneal/sln_tchng/CHEM620/CHEM620/Chi_6._Interference_%26_Diffraction.html (Year: 2010).*
Takizawa, Fluorescent Body and Light-Emitting Device Using Same, Sep. 19, 2013, WO2013136732A1, English (Year: 2013).*
International Search Report and Written Opinion for PCT/US2016/059543 dated Feb. 9, 2017.
Chinese Office Action dated Dec. 26, 2019, Chinese Application No. 201680061417.6, 17 pages.

* cited by examiner

METHODS AND APPARATUS FOR INTRINSICALLY SAFE LASER SOURCED ILLUMINATION

TECHNICAL FIELD

Aspects of the present application relate in general to laser illumination systems and in particular to an intrinsically safe laser sourced illumination system.

BACKGROUND

Vehicle lighting systems have two basic purposes. The first purpose is to improve the vehicle visibility so that other drivers of other vehicles, pedestrians or animals can more easily be alerted to a vehicle's presence and motion. The second purpose is for the forward facing light, typically produced by headlights, to illuminate objects in front of the vehicle so that the vehicle's driver can be aware of their presence and have the opportunity to operate the vehicle so as to avoid colliding with them. The farther ahead objects can be illuminated, the faster a vehicle can be safely piloted.

Headlight systems that utilize laser light as their light source have been found to project lighting to a distance that is about twice as far as the closest competing technologies, to consume 30% to 50% less power and are also found to be more compact. Several automobile manufacturers, e.g., BMW and Audi, have tested laser sourced head lights and have confirmed the increased illumination distance, which enhances the opportunity for a driver to safely pilot the vehicle. With the benefits that the laser sourced headlights provide, future implementations are desirable for a number of applications for illumination such as headlights, headlamps and the like on land, sea or air.

Despite the enhanced driver visibility benefits of the laser sourced headlights, safety concerns due to the laser light sources in these systems remain an issue. The OSHA Technical Manual, Section 6, Chapter 3 (https://www.osha.gov/dts/osta/otm/otm_iii/otm_iii_6.html) identifies the various harmful effects of "highly collimated" laser light, specifically calling out biological damage that can occur from "blue laser light." To address these safety issues, multiple engineering controls have been implemented to prevent exposure of the laser light outside of the headlight systems. The prior known safety systems are configured to shut down power to the laser source in a prior known illumination system in various failure modes or operational scenarios. Some examples include having the laser source be active only when the vehicle speed exceeds, for example, 40 mph. This feature was fostered on the premise that traditional incandescent headlights will be used to illuminate objects in front of the vehicle at speeds up to 40 mph. At speeds above 40 mph, laser sourced headlights can be enabled to illuminate objects at an even greater distance ahead than traditional headlights. Fortunately, with the 40 mph feature, the prior known system ensures that a human or animal observer standing next to a parked vehicle would not be able to peer in to a headlight assembly and expose their eyes to the laser light. Additional prior known safety features for laser sourced illumination systems use a sensor or detector to monitor the amount of blue laser light in the headlight beam. If an irregular amount of laser energy is detected, the system will disrupt the laser power. The prior known headlight systems can output laser energy in the headlamp beam if a failure such as a dislocated mirror, laser misalignment, accident damage, etc. should occur.

In additional known prior approach safety systems, the system will disrupt power to the laser sources in the case of an impact. Each of these known approaches anticipates some failure in the system and then acts after the fact to disrupt power to the laser source. However, the safety system and its component pieces, including a sensor, ECU (electrical control unit) and power interrupting system (typically a relay), are assumed to be in working order and these prior safety mode systems offer additional sources of failure. In the event of a failure of one of the components in the safety system, the ability to prevent the laser light from emitting from the headlight source would be in question and those possibilities continue to raise concerns that a human eye or tissue could be exposed to collimated laser energy and may be damaged as a result. Further, in some systems, the need for the non-laser headlights at lower speeds means the systems are relatively expensive, and the benefit of the additional visibility for the driver is limited to highway or at least relatively high speed situations.

An example of an existing laser sourced headlight that has been tested is described as follows. FIG. 1 depicts a top view of a prior art laser sourced headlight assembly. In 100 a laser headlight assembly 102 contains three blue laser diode sources 110A, 110B, 110C. The blue lasers can emit light that is blue or violet to the human eye such as a range from 400-450 nanometers in wavelength. Such semiconductor diode lasers are used, for example, in optical disk systems known as "Blu-ray." The three blue laser diode sources in FIG. 1 are used to produce collimated blue laser light 130 focused on mirrors 112A, 112B, 112C. Beams from laser sources 110A and 110C are situated to travel either under or over the reflector 114. The three mirrors 112A, 112B and 112C, reflect the laser beams to a phosphor coated reflective element 118 that is positioned at the rear of the final lens 116. When the laser beams hits the phosphor element, the phosphor fluoresces and produces a bright yellow light. The blue laser beams are dispersed in the process and when these blue laser beams are combined with the yellow light, the combined light energy appears as a white light. This white light is then redirected by reflector 114 out of the front lens 116 to provide illumination. Once the blue laser light is dispersed, the intensity of the laser energy that is emitted from the system 100 drops below the threshold for biological damage and thus relieves the safety issues of the collimated laser light.

An opportunity for the laser beam light to escape from the prior art headlight assembly 100 may occur in a partial or full failure of the phosphor coating on the phosphor element 118. In this event, some or all of a laser beam would not be dispersed and could be redirected out of the headlight as collimated laser light. Another opportunity for laser energy to be emitted would be in the case of a dislodging of one of the reflecting mirrors 112. In that event, the laser beam would be directed forward. And another opportunity for laser emission could be if the phosphor element became dislodged. In that event the laser beams of the prior known approach headlight would have no dispersing element and would be pointed forward. A last example failure mode can occur if one or more of the laser sources 110 became redirected away from its reflecting mirror 112, then its collimated laser beam would be pointed towards the front of the headlight. In a prior known approach headlight system like the one of FIG. 1, a detector 156 in the output light 150 could be used to monitor the content of laser energy in the light and then when a limit was exceeded, the power to the laser diodes 110 could be interrupted. However laser energy above the biological safety threshold would be emitted before the sensor 156 detects it; and the safety of the system 100 also depends on the proper operation of the sensor. If the sensor 156 is lost or damaged due to an accident, for example, the power to the laser diodes 110A-110C may continue and collimated laser energy in excess of a safe limit could be emitted from the headlight.

Improvements to the safety of laser sourced illumination devices, such as in headlights and headlamps, are thus required. Improvements in the laser sourced headlight to make it intrinsically safe, such that an additional sensor system is not required to stop or reduce the chance for collimated light to escape the headlight enclosure, would be beneficial to the safety and to the industry and increase societal acceptance of the laser sourced illumination technology.

SUMMARY

Various arrangements of the present application provide intrinsically safe illumination using laser illumination sources. In aspects of the present application, laser illumination sources are arranged with a phosphor element and mirror apparatus such that, in the case of one of several possible failures, laser energy does not leave the illumination system. Further the novel safety features are unexpectedly accomplished without the need for additional detectors or sensors, and are intrinsic to the arrangements; even if the laser illumination sources remain powered after a failure, laser energy does not exit the system and safety of the systems is therefore greatly enhanced over the prior known approaches.

In an example arrangement a system for illumination includes a plurality of laser illumination sources configured to transmit laser beams; a dichroic mirror spaced from the plurality of laser illumination sources and having an aperture configured to allow the laser beams to pass through the dichroic mirror, the remaining surfaces of the dichroic mirror configured to reflect the laser beams; a phosphor element spaced from the dichroic mirror and coated with a substance to fluoresce when struck by the laser beams and configured to disperse the laser beams and to output combined light that includes fluorescent light and the dispersed laser beams; and an illumination output arranged to receive the combined light from the phosphor element and to output illuminating light containing both the fluorescent light and the dispersed laser beams.

In another arrangement, in the above system, the plurality of laser illumination sources further include laser diodes. In still a further arrangement in the above system, the laser diodes output blue or violet laser light. In still another arrangement, in the above described system, the laser diodes output laser light having a wavelength between 400 and 460 nanometers.

In a further arrangement, in the system described above, the phosphor element is configured to fluoresce yellow when struck by the laser beams.

In still another arrangement, in the above described system, the system further includes the dichroic mirror being angled to the direction of the laser beams from the laser diode; and the phosphor element reflecting fluorescent light and dispersed laser light back to the dichroic mirror; wherein the dichroic mirror reflects the light from the phosphor element to the illumination output.

In yet another arrangement, in the above described system, if the phosphor is displaced from its original position, the laser beams are not reflected and no laser light is output from the illumination output. In still another arrangement, in the above system, wherein if a phosphor coating on the phosphor element is dislocated, the phosphor substrate reflects the laser beams directly back to the aperture in the dichroic mirror, and no laser beams are output at the illumination output.

In still another alternative arrangement, in the above described system, wherein if the laser illumination sources are displaced from the original position, the laser beams from the illumination sources strike the reflective surface of the dichroic mirror and do not enter the aperture.

In yet another alternative arrangement, in the above described system, the system further includes a condensing lens and a collimation lens positioned between the dichroic mirror and the phosphor configured to focus the laser beams onto the phosphor element.

In still a further alternative arrangement, in the above described system, the system further includes a set of lenses positioned between the phosphor and the illumination output, and configured to collimate the light from the phosphor for outputting the light.

In yet a further arrangement, in the above described system, if the phosphor loses a coating, the substrate of the phosphor element is configured to reflect the laser beams back through the condensing lens and the collimation lens and through the aperture dichroic mirror, so that no laser light is output from the illumination output.

In an example method arrangement, the method includes arranging a plurality of laser illumination sources in correspondence with an aperture in a dichroic mirror spaced from the laser illumination sources, the surfaces of the dichroic mirror being reflective of the laser light; outputting laser beams from the plurality of laser illumination sources through the aperture in the dichroic mirror; directing the laser beams onto a phosphor that fluoresces in response to the laser beams and which outputs combined light that includes the fluorescent light and dispersed laser light; and outputting the combined light at an illumination light output.

In still a further example arrangement, the above described method includes if the laser illumination sources are dislocated, the laser beams strike the reflective surfaces of the dichroic mirror and are reflected such that no laser beams are output from the illumination output.

In a further example arrangement, the above described method further includes wherein if the phosphor loses its phosphor coating, the substrate of the phosphor is reflective to the laser beams, and the laser beams are reflected back through the aperture in the dichroic mirror so that no laser beams are output at the illumination output.

In yet another example arrangement, the above described method further includes positioning the dichroic mirror at an angle to the path of the laser beams; reflecting the combined light from the phosphor to the dichroic mirror; and reflecting combined light from the dichroic mirror to the illumination output.

In still another example, in the above described method, the method further includes wherein if the phosphor becomes dislocated, the laser beams are not reflected back to the dichroic mirror, and no laser beams are output from the illumination output.

In another example arrangement, a headlight with laser illumination sources includes a plurality of laser diodes arranged in a pattern; a dichroic mirror spaced from the plurality of laser diodes, and having an aperture placed in correspondence to the pattern, the remaining surface of the dichroic mirror being reflective to laser beams; a phosphor having a coating configured to fluoresce when impacted by laser beams from the laser diodes, the phosphor spaced from the dichroic mirror on a side opposite the laser diodes, the phosphor configured to output combined light including fluorescent light and dispersed laser light when impacted by the laser beams; and an output of the headlight positioned to receive the combined light from the phosphor and to output illumination light; wherein if any of the plurality of laser diodes and the phosphor become dislocated, the laser beams are directed so that no laser beams are transmitted to the output.

In still another example arrangement, in the above described headlight, wherein the dichroic mirror is angled with respect to the direction of the laser beams from the plurality of laser diodes, and the combined light from the phosphor is reflected back to the dichroic mirror and then reflected from the dichroic mirror to the output of the headlight.

In still another example arrangement, in the above described headlight, wherein if the phosphor loses its coating, the phosphor substrate reflects the laser beams back through the aperture in the dichroic mirror, and no laser beams are transmitted to the output of the headlight.

The examples and illustrations provided herein describe certain arrangements that provide an explanation of aspects of the present application but the application is not limited to these examples and additional alternative arrangements can be formed by varying these arrangements to form additional arrangements that are contemplated by the inventor and which are within the scope of the appended claims.

BRIEF DESCRIPTION OF THE DRAWINGS

For a more complete understanding of the illustrative examples of aspects of the present application that are described herein and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the illustrative example arrangements and are not necessarily drawn to scale.

DETAILED DESCRIPTION

The making and using of various example illustrative arrangements that incorporate aspects of the present application are discussed in detail below. It should be appreciated, however, that the illustrative examples disclosed provide many applicable inventive concepts that can be embodied in a wide variety of specific contexts. The specific examples and arrangements discussed are merely illustrative of specific ways to make and use the various arrangements, and the examples described do not limit the scope of the specification, nor do they limit the scope of the appended claims.

For example, when the term "coupled" is used herein to describe the relationships between elements, the term as used in the specification and the appended claims is to be interpreted broadly, and while the term "coupled" includes "connected", the term "coupled" is not to be limited to "connected" or "directly connected" but instead the term "coupled" may include connections made with intervening elements, and additional elements and various connections may be used between any elements that are described as "coupled."

An intrinsically safe laser illumination system is one where additional control systems are not required to sequester or contain the collimated laser light from exiting the illumination system. The following paragraphs will illustrate a safe laser illumination system that operates safely without the need for additional safety systems. However, in alternative arrangements that are contemplated by the inventors, a sensor such as described above with respect to prior known arrangements can be used in conjunction with the intrinsically safe laser illumination system and the benefits of the use of the arrangements would still accrue in such an alternative arrangement.

Figure 1:
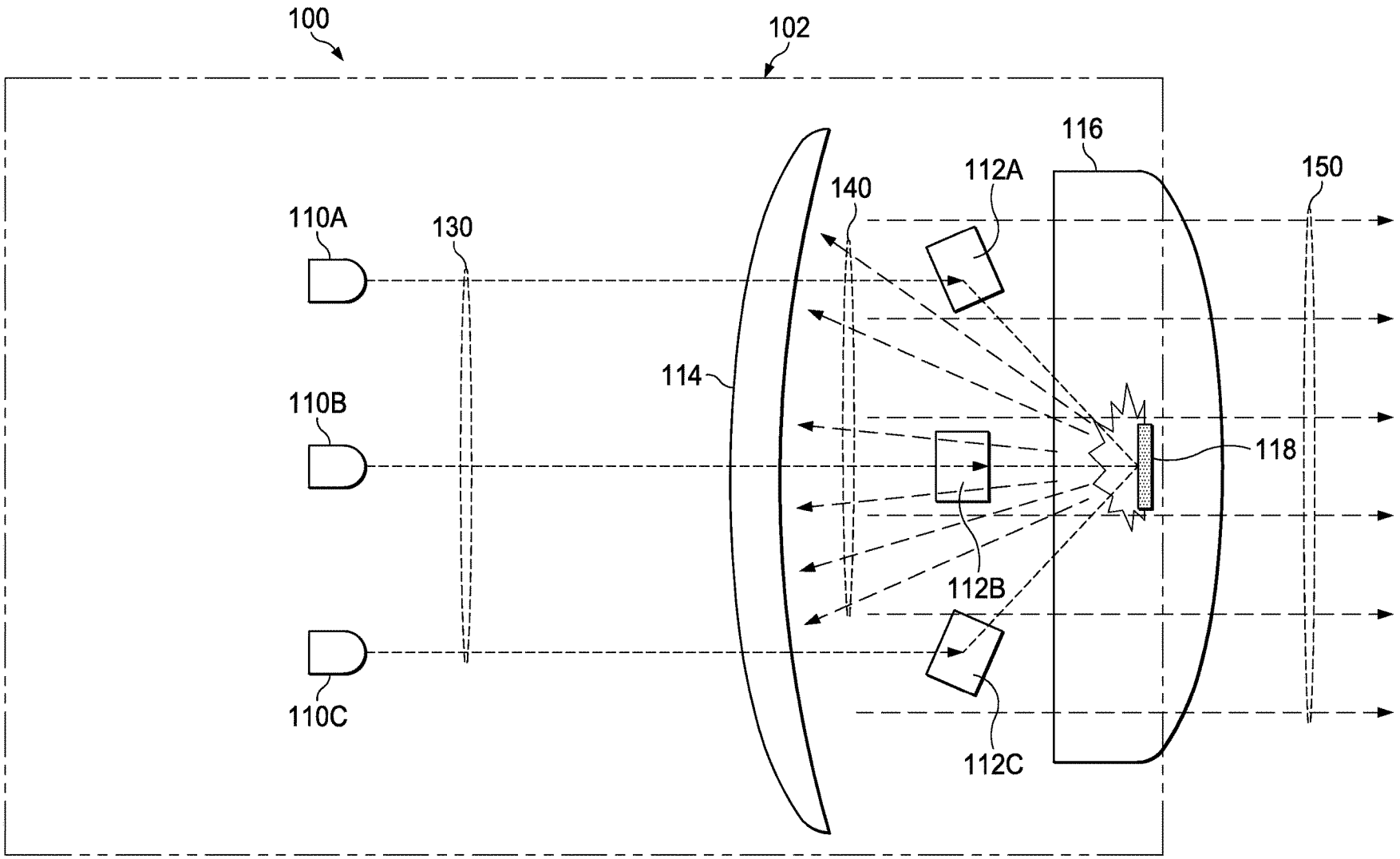
FIG. 1 (PRIOR ART)
FIG. 1 depicts a top view of a prior art laser sourced headlight assembly.
Figure 2:
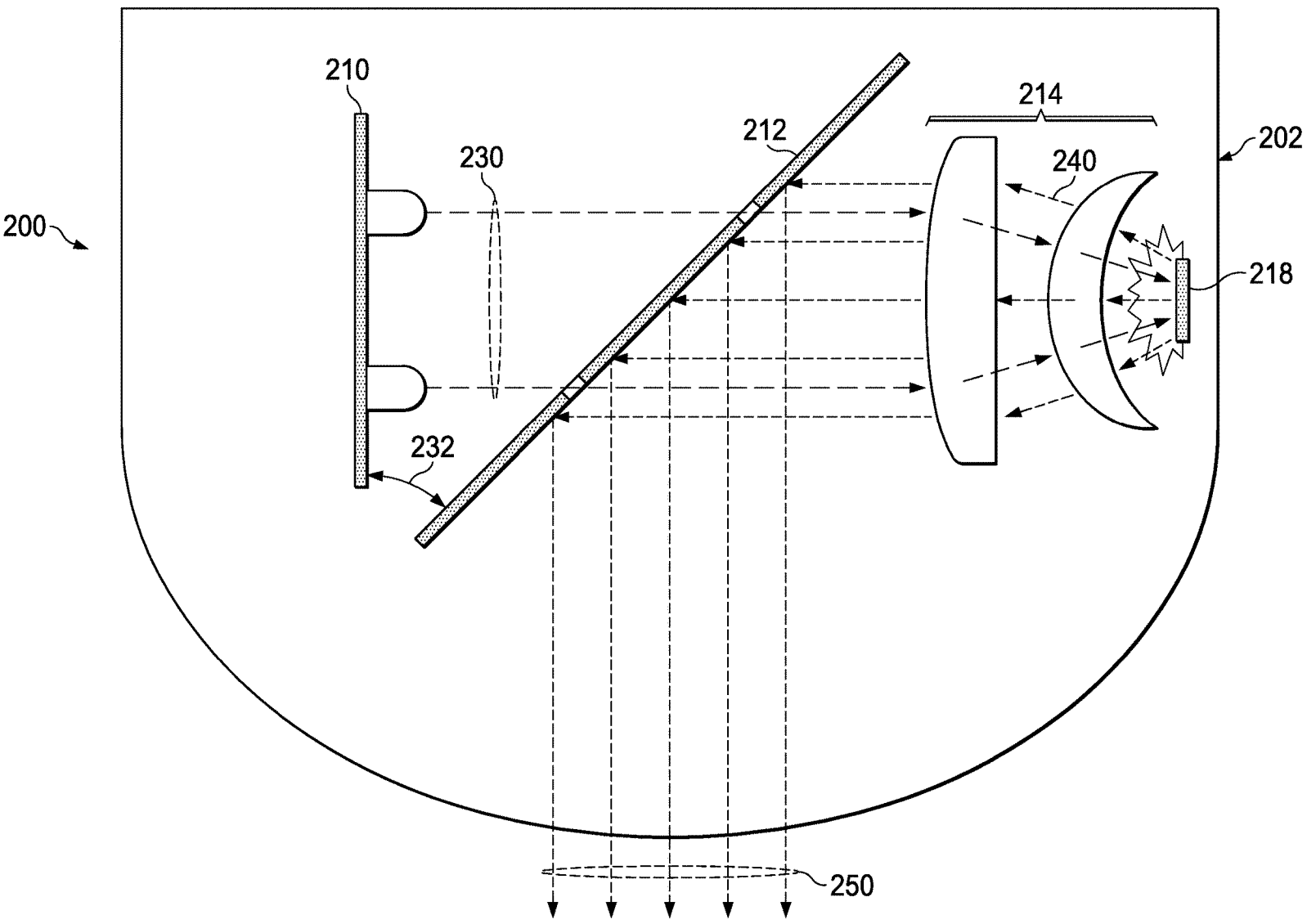
FIG. 2 depicts a top view of an intrinsically safe laser illumination system of the present application utilizing a folded light path.

FIG. 2 depicts a top view of an intrinsically safe laser illumination system 200 utilizing a folded light path. In FIG. 2, a laser illumination headlamp 202 contains a laser array 210 whose laser beams 230 are directed through apertures in a dichroic mirror 212 and through a focusing and collimating lens set 214 to focus on a reflective yellow phosphor element 218. The light from the phosphor substrate travels back through the lens set 214 and is reflected off the dichroic mirror 212 and out of the headlamp or illumination system 202 as depicted by light rays 250. The lens set 214 may contain one or more lenses to achieve its purpose of collimating and focusing the laser beams on the reflective phosphor substrate. Of special interest in this example of the present application is the function of the dichroic mirror 212 which is mounted at an angle 232 to the laser diode array 212. The approximate angle of the mirror in one example arrangement would be 45 degrees, however the mirror 212 can be arranged at other angles in such a manner that the light paths depicted are accomplished with the intent of reflecting laser beams 230 to a safe location in the case where the laser array 210 and dichroic mirror 212 become misaligned, as is further described below. The dichroic mirror 212 reflects yellow and blue light on the front and back surfaces. The exception is that there is aperture area that is aligned to the laser diode array 210 which still reflects yellow light, but allows blue laser beams 230 to pass either direction through the mirror. A better understanding of the laser diode array and dichroic mirror may be attained by examining the further details presented in FIGS. 3A and 3B.

Figure 3A:
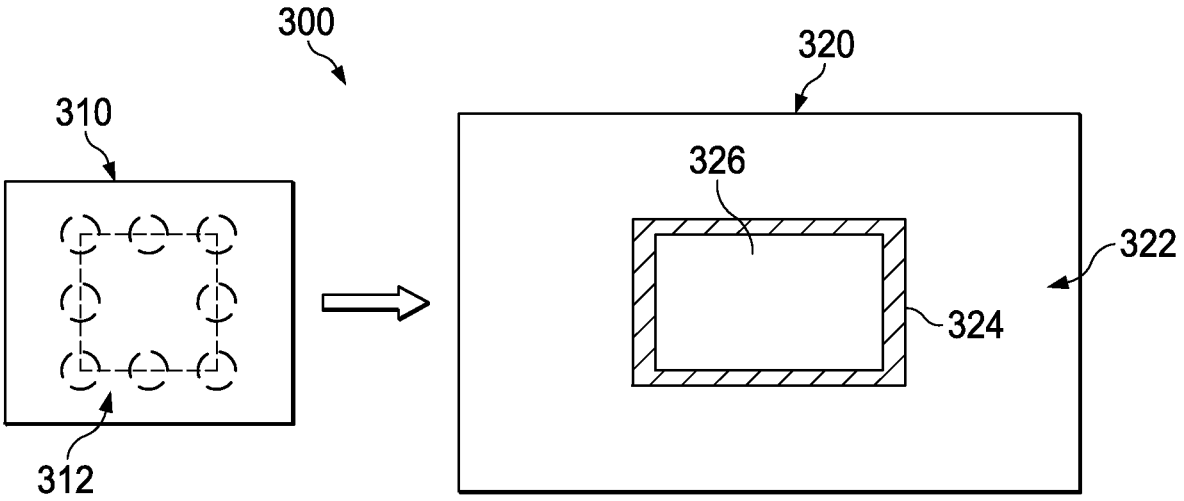
FIGS. 3A and 3B each depict in a front view a pair of laser diode arrays and dichroic mirrors for an intrinsically safe laser illumination system for use in arrangements of the present application.
Figure 3B:
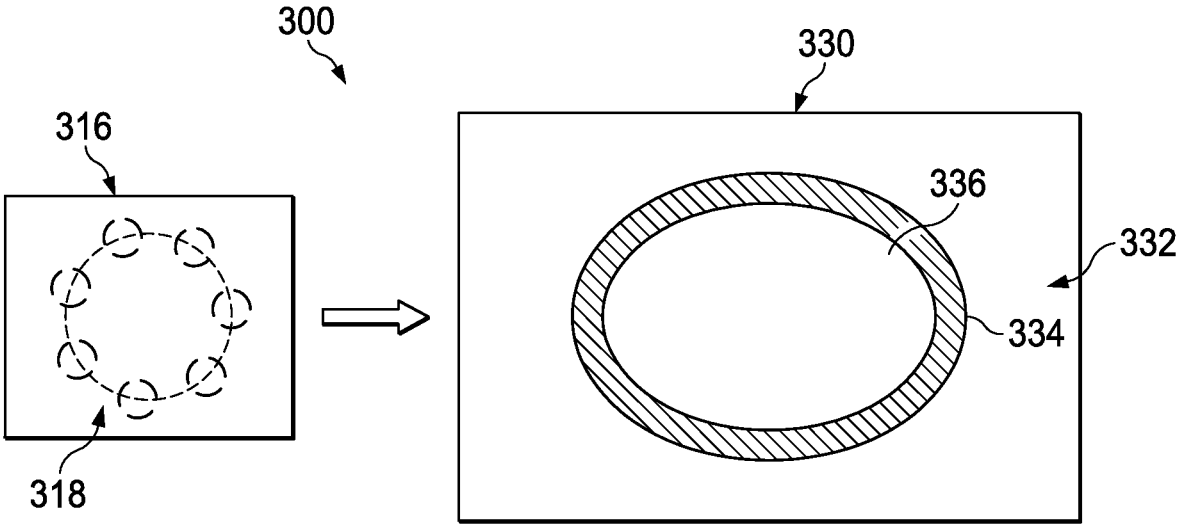

FIGS. 3A-3B each depict in aspects of the present application a front view of a pair of arrangements for laser diode arrays and dichroic mirrors for an intrinsically safe laser illumination system. FIG. 3A illustrates a laser array 310 which contains, in a non-limiting example, eight laser diode sources 312 that are arranged in a square pattern. Element 320 is a dichroic mirror with a rectangular aperture 324. Dichroic mirror 320 is designed to reflect blue and yellow light on front and back surfaces. An exception is the aperture area 324 which will allow blue light to pass in either direction. The size and position of the aperture 324 will coincide with the laser array 310 in such a manner that when the mirror 320 is aligned, in an example arrangement to illustrate the features, at about 45 degrees to the array, the mirror aperture 324 will allow the blue laser beams to pass through the mirror 320. Laser array 310 is depicted with the laser sources 312 in a square pattern that corresponds to the mirror aperture 324 in the mirror 320 that is rectangular when viewed directly from the front as illustrated, but not necessarily to scale.

FIG. 3B depicts a second example arrangement of the present application with a laser array 316 where the laser diode sources 318 are arranged in a circular pattern. Element 330 is another dichroic mirror with an oval aperture 334. This mirror 330 is designed to reflect blue and yellow light on front and back surfaces. An exception is the aperture area 334 which will allow blue light to pass in either direction. Laser array 316 depicted with the laser sources 318 in a circular pattern corresponds to the mirror aperture 334 in the mirror 330 being an oval shape when viewed directly from the front as illustrated, but is not necessarily drawn to scale. The inventor contemplates additional laser diode layout patterns and corresponding dichroic mirror arrangements that form further aspects of the present application, each of these arrangements will allow laser light to pass through one or more apertures in a mirror while reflecting light in other areas of the mirror. Example arrangement that are contemplated as providing additional aspects of the present application includes arrangements with multiple apertures in the mirror with corresponding laser layouts.

In both of the non-limiting illustrative example arrangements shown in FIG. 3A and FIG. 3B, the mirror apertures are symmetric to allow the laser beams to pass back to front through the mirror and also front to back through the mirror. In the event of a partial or total failure of the phosphor coating in a system incorporating the mirrors of FIG. 3A or 3B, the laser beams would be reflected off the substrate surface of the phosphor and then would be directed back through the symmetric aperture of the mirror, preventing collimated laser light from exiting the headlight system. The following examples illustrate the intrinsically safe nature of this illumination system in view of different possible failure mechanisms.

Figure 4:
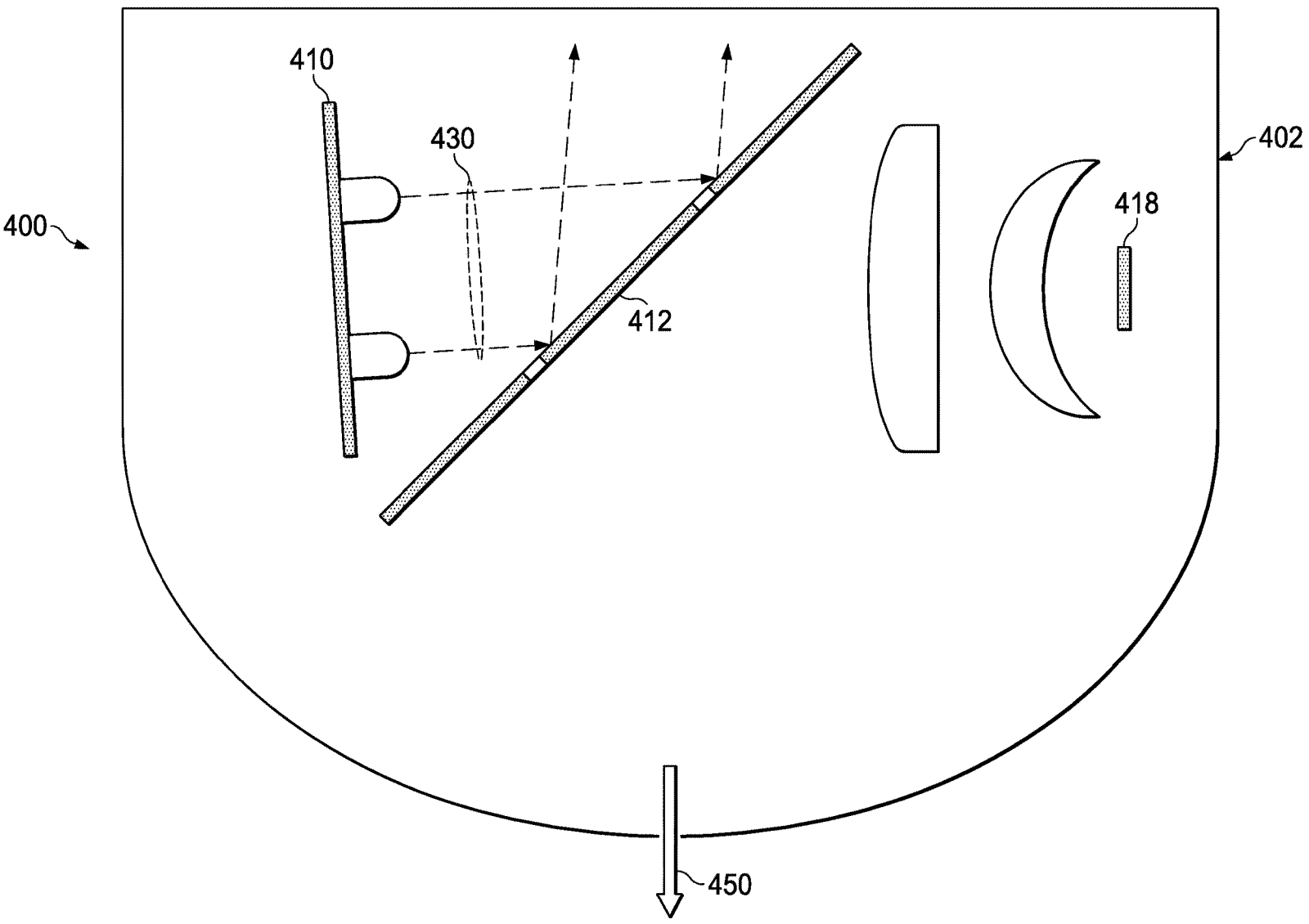
FIG. 4 depicts in another top view the intrinsically safe illumination system of FIG. 2 with an example shifted laser diode array failure.

FIG. 4 depicts in a top view the intrinsically safe illumination system of FIG. 2 with a shifted laser diode array failure. Depicted in 400 is an intrinsically safe illumination headlight or headlamp assembly 402 similar to 202 depicted in FIG. 2, retaining the numerical assignments, only now in the 400 series. Assembly 402 includes the laser source 410, laser beams 430, dichroic mirror 412, phosphor element 418 and the light output 450. In this illustration, the laser array 410 is shown shifted or rotated in position with respect to the dichroic mirror 412 in such a manner that the laser beams 430 are now not aligned with the apertures in the dichroic mirror 412.

In this example, the laser beams 430 are reflected away from the normal output direction 450 of the illumination system and do not exit the illumination system. This is an intrinsic safety feature of this arrangement and does not require any detectors, ECUs nor power interrupt systems to contain the laser beams. Power can remain on for the laser diodes 410 without endangering human or animal observers as no laser energy is emitted from assembly 402 at output 450 in this example failure.

Figure 5:
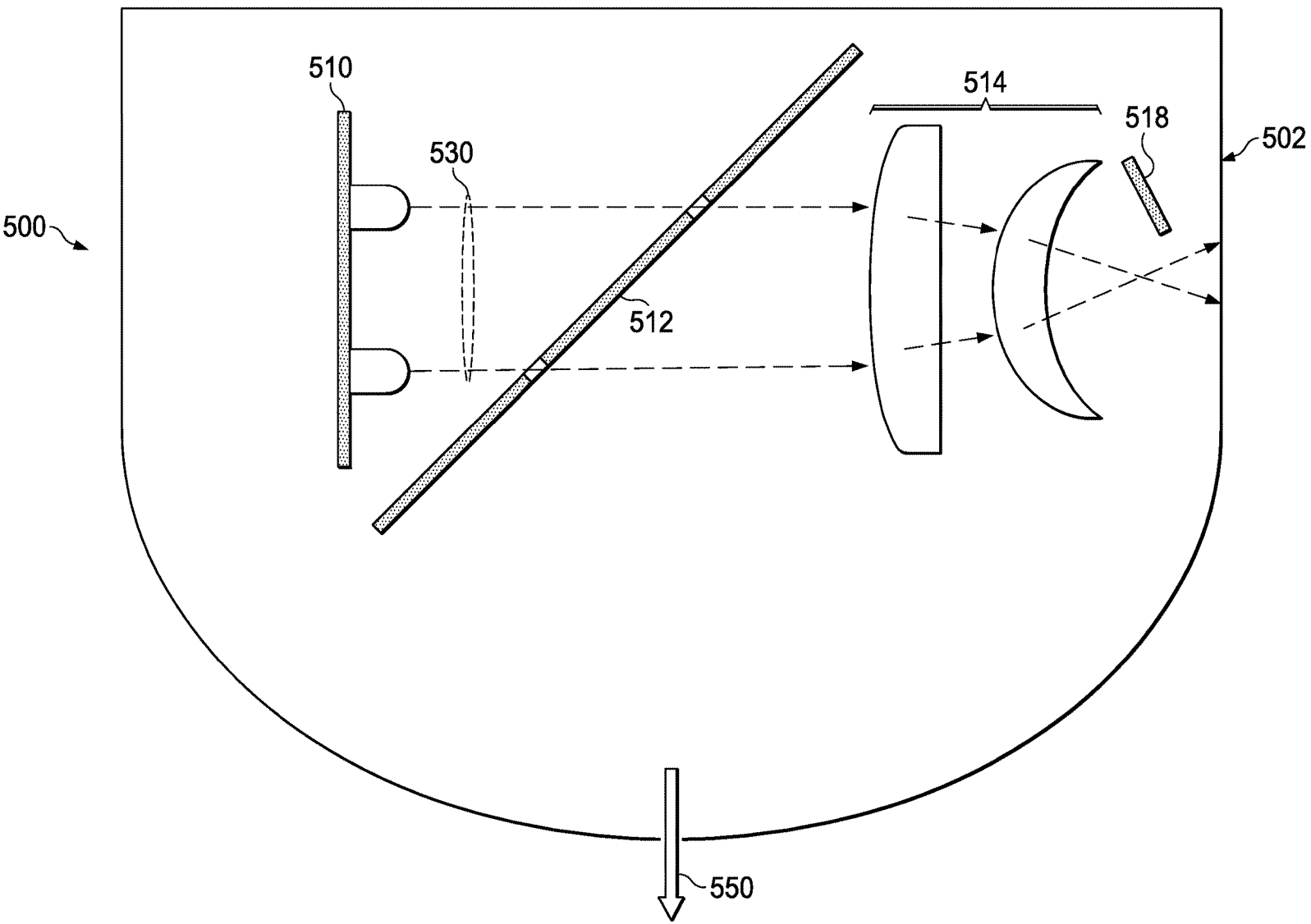
FIG. 5 depicts in yet another top view the intrinsically safe illumination system of FIG. 2 with missing yellow phosphor substrate failure.

FIG. 5 depicts in another example the intrinsically safe illumination system of FIG. 2 with a missing yellow phosphor substrate failure. Depicted in FIG. 5 is an intrinsically safe illumination arrangement 502 such as was depicted in FIG. 2 as 202, retaining the numerical assignments, only in the 500 series. The assembly 502 includes the laser source 510, laser beams 530, dichroic mirror 512, lens set 514, phosphor element 518 and the light output 550.

In this example, the yellow phosphor substrate 518 is not in its proper location. Laser array 510 supplies laser beams 530 which are in alignment with the dichroic mirror 512. The laser beams pass thru the lens set 514 but do not energize the dislocated yellow phosphor substrate 518. Without striking the substrate 518 (which is now out of the designed position), the laser beams cross and are not reflected and are thus contained within the illumination system. In this example, the laser beams are contained away from the normal output direction 550 of the illumination system 500 and do not exit the illumination system. The system 500 is thus intrinsically safe. The safety features do not require any detectors, ECUs nor power interrupt systems to contain the laser beams. Power can remain on to the laser diode array 510 without risk that any laser energy is emitted from the assembly 502.

Figure 6:
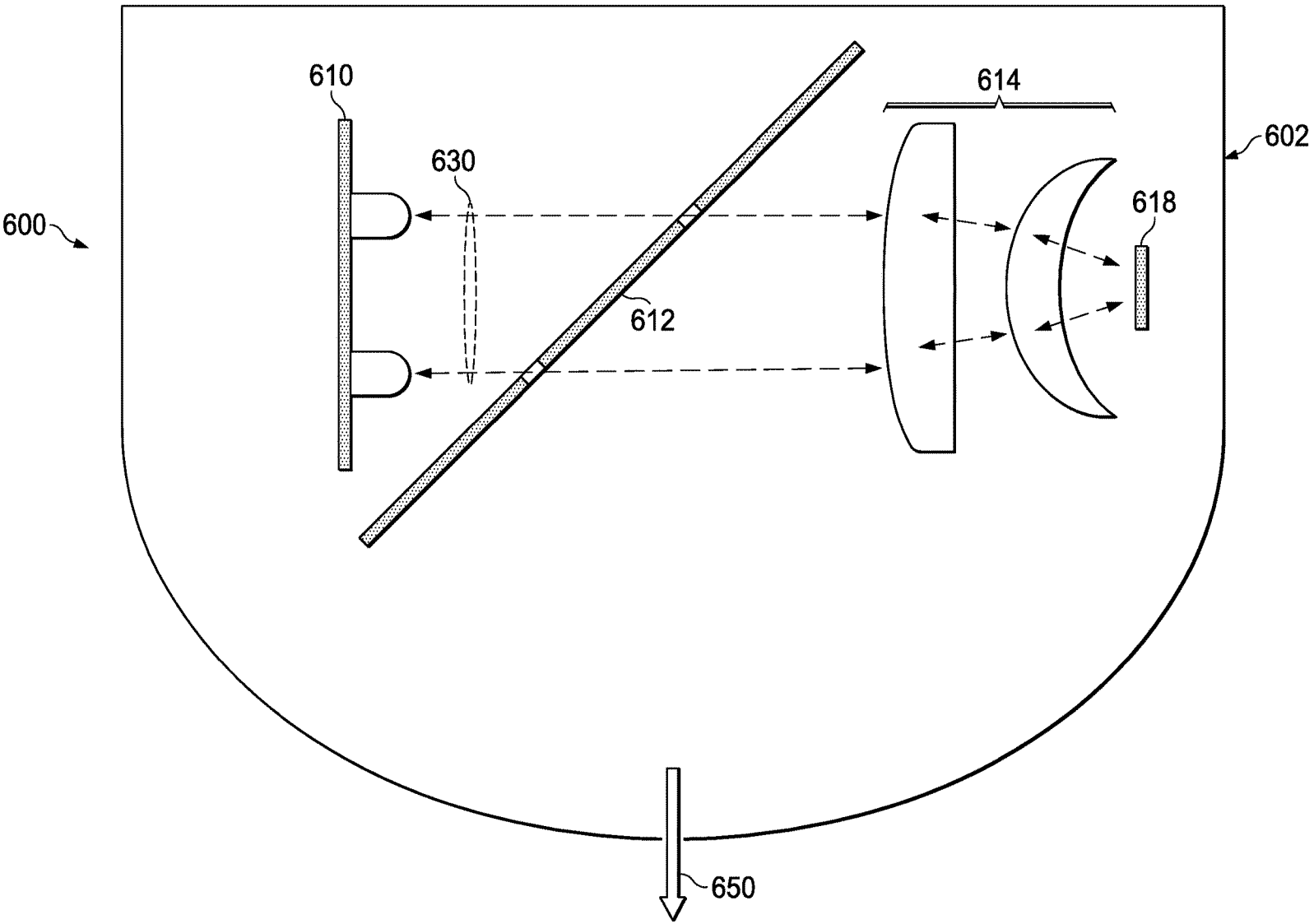
FIG. 6 depicts in a top view the intrinsically safe laser illumination system of FIG. 2 with an example phosphor element coating failure.

In yet another example, FIG. 6 depicts in a top view an intrinsically safe laser illumination system 600 such as that of FIG. 2 illustrating an example of a yellow phosphor coating failure. Depicted in FIG. 6 is an intrinsically safe illumination assembly 602 as depicted in FIG. 2 retaining the numerical assignments, only now with numbers in the 600 series. The arrangement 602 of FIG. 6 includes the laser source 610, laser beams 630, dichroic mirror 612, lens set 614, phosphor element 618 and has the light output 650.

In this example illustration, the phosphor coating on element 618 has fully or partially delaminated exposing the reflective substrate of the phosphor element 618 in whole or part. In the example of FIG. 6, the laser array 610 produces laser beams 630 which pass thru an aperture in the dichroic mirror 612. The laser beams then pass through lens set 614 and are focused on the yellow phosphor element 618. In this failure example, all or part of the laser beams will be reflected by the reflective substrate of the phosphor element 618. With the symmetric nature of the laser array 610 and aperture on the dichroic mirror 612, the non-disbursed portion of the beams are simply reflected off the substrate and back to the original laser diodes as shown by the double ended beam arrow 630. Without the phosphor coating the beams are simply reflected and contained within the illumination system housing. This is an intrinsic safety feature of this arrangement and does not require any detectors, ECUs nor power interrupt systems to contain the laser beams.

Figure 7:
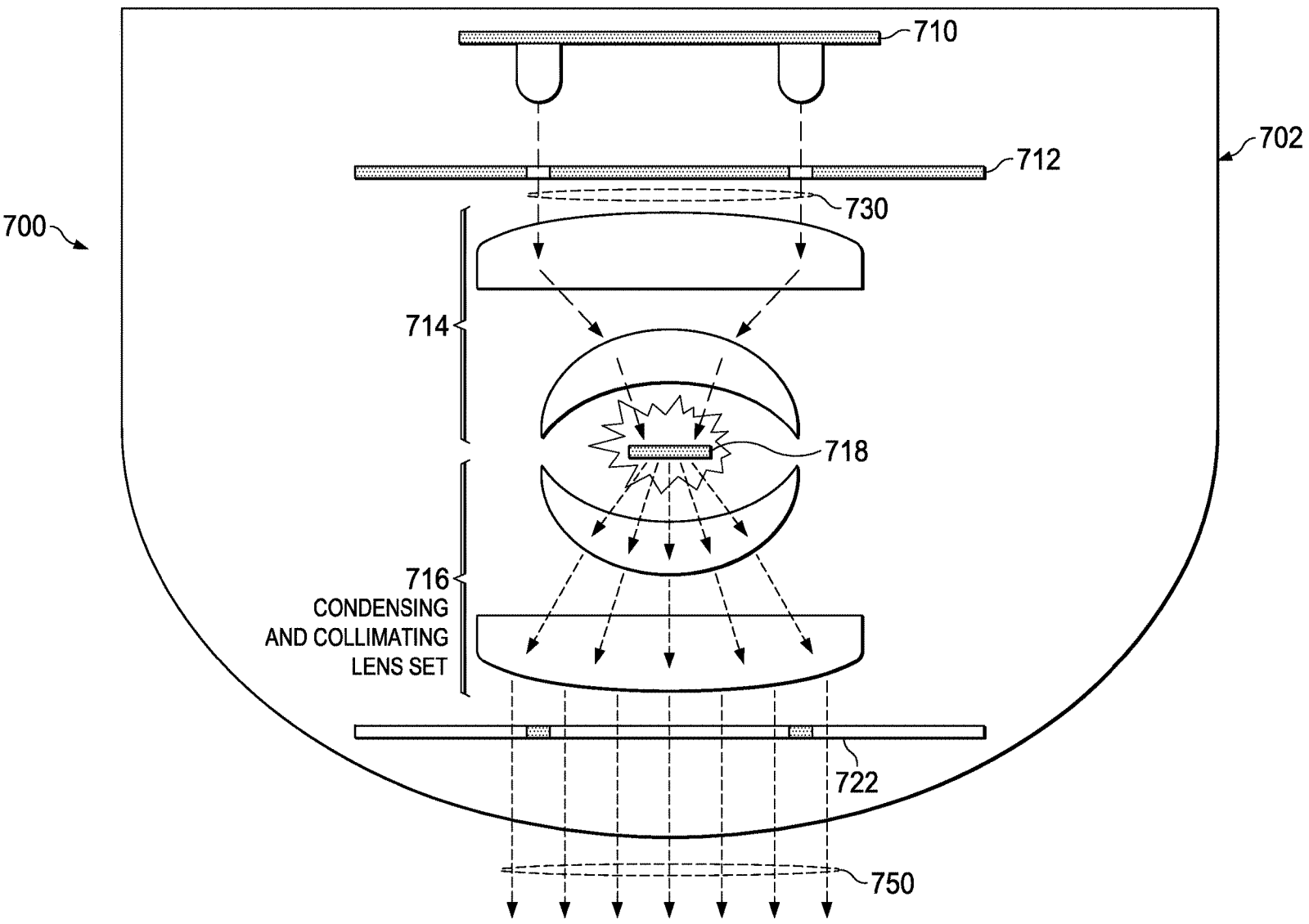
FIG. 7 depicts a top view of another example of an intrinsically safe laser illumination arrangement of the present application utilizing a linear light path.

FIG. 7 depicts in a top view another example arrangement of an intrinsically safe laser illumination system 700 utilizing a linear light path. Illustrated in FIG. 7 is a top view of an intrinsically safe lighting assembly 702 which contains a laser light source 710 coupled to a condensing lens system 714 through a dichroic mirror 712. The focusing lens directs light energy to a light dispersing element 718. Following the dispersing element 718 s a collimating lens set 716 which directs the light energy 750 out of the lighting assembly 702 thru a second dichroic mirror 722.

In this example arrangement of the present application, a laser light source 710, which has laser diodes arranged in a symmetric pattern, is aligned so that the laser beams 730 pass through an aperture in a dichroic mirror manufactured to pass the laser light. The laser light beams 730 are then focused by the condensing lens set 714 and directed to a yellow phosphor coated element 718. When the laser light 730 hits the element 718, the yellow phosphor fluoresces emitting a bright, dispersed light. That light consists of yellow and blue light and appears as white light. Following element 718 is a collimating lens set 716 which gathers the emitted light and directs it out the front of the lamp system through a second dichroic mirror 722 as depicted by beams 750. For better explanation, the laser diode array and dichroic mirror of FIG. 7 are also detailed in FIGS. 8A-8B.

Figure 8A:
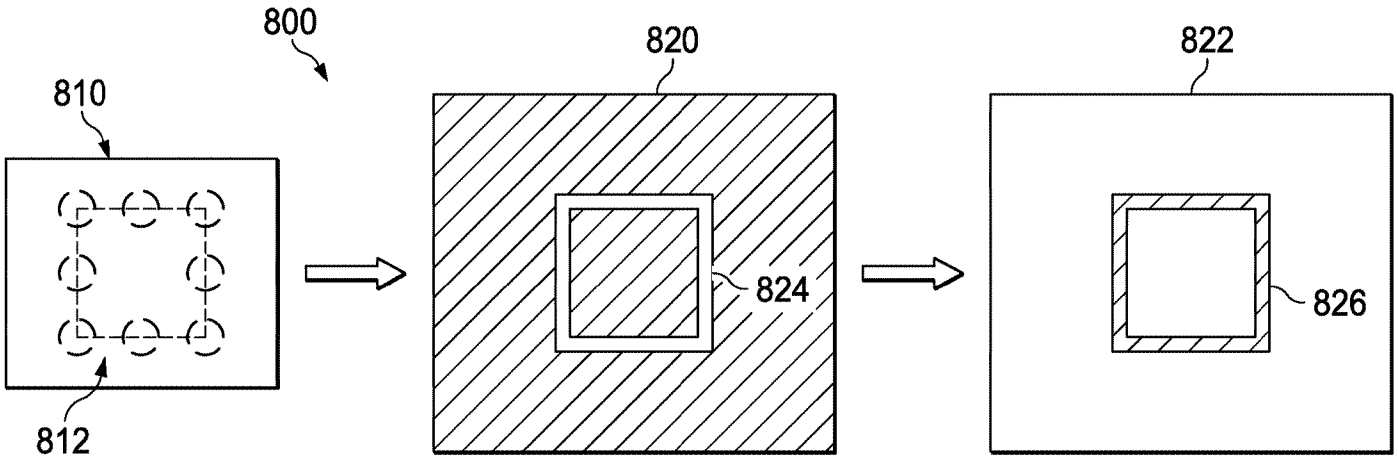
FIGS. 8A-8B each depict a front view of laser diode arrays and dichroic mirrors for use in the intrinsically safe laser illumination system arrangement of FIG. 7.
Figure 8B:
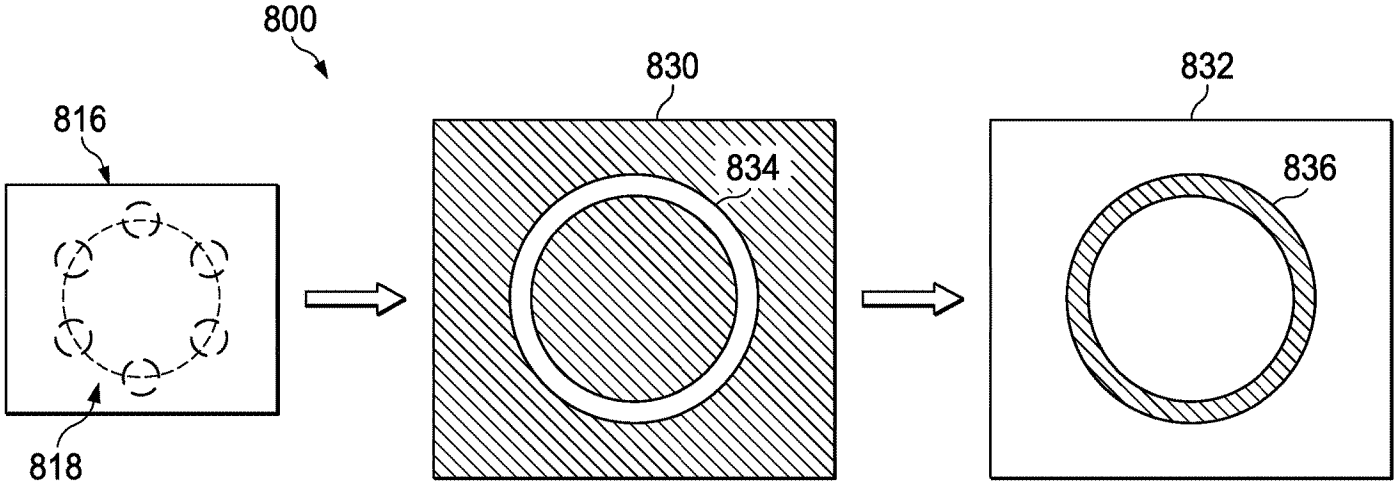

FIGS. 8A-8B each depict in a front view of a pair of laser diode arrays and a pair of dichroic mirrors that can be used in the arrangements such as for the intrinsically safe laser illumination system of FIG. 7. FIG. 8A depicts a laser array 810 which contains, in this non-limiting illustrative example, eight laser diode sources 812 that are arranged in a symmetric pattern as a square or rectangle. More, or fewer, laser diode sources can be used in forming alternative arrangements. Element 820 is a dichroic mirror with a square aperture 824. Dichroic mirror 820 is designed to reflect blue and yellow light on front and back surfaces except in area 824 where blue light can pass in either direction through the dichroic mirror. The size of the aperture 824 will correspond with the laser array 810 in such a manner that when the mirror is aligned perpendicular to the laser light array, the mirror's aperture 824 will allow the blue laser beams to pass through the mirror. Element 822 is a second dichroic mirror with a square aperture 826. Dichroic mirror 822 is designed to reflect blue light in the square area 826 and pass light in all other areas. The size of the reflective area 826 will correspond with the laser array 810.

FIG. 8B depicts another example of a laser diode light source 816 and mirrors 830 and 832 which can be used with the laser light illumination system in FIG. 7. Laser light source 816 is illustrated with, in this example, six laser diodes sources 818 arranged in a symmetric circular pattern. Dichroic mirror 830 is provided with a circular shaped aperture 834. The mirror 830 reflects blue and yellow light on both surfaces except in the aperture area 834 where blue light is allowed to pass in either direction thru the mirror. The aperture 834 is designed and sized so that when the mirror 830 is positioned perpendicular to the laser light source 816, the laser sources 818 are aligned with the aperture with their light passing through the aperture. Dichroic mirror 832 is provided with a circular shaped area 834. The mirror 832 reflects blue and yellow light in the circular area 836 and passes light in all other areas. The size of the reflective area 836 will correspond with the laser array 816.

In both example arrangements depicted in FIGS. 8A and 8B, the area 824, 826 are symmetric to allow the laser beams to pass through the mirror in both directions. The intrinsically safe features of the arrangements are discussed with respect to the following figures. In addition to these example arrangements, many other laser diode patterns can be used, and corresponding shapes can be formed on the dichroic mirrors as shown in the examples. Alternative arrangements can be formed by using various patterns for the laser diodes and the mirrors as shown above.

Figure 9:
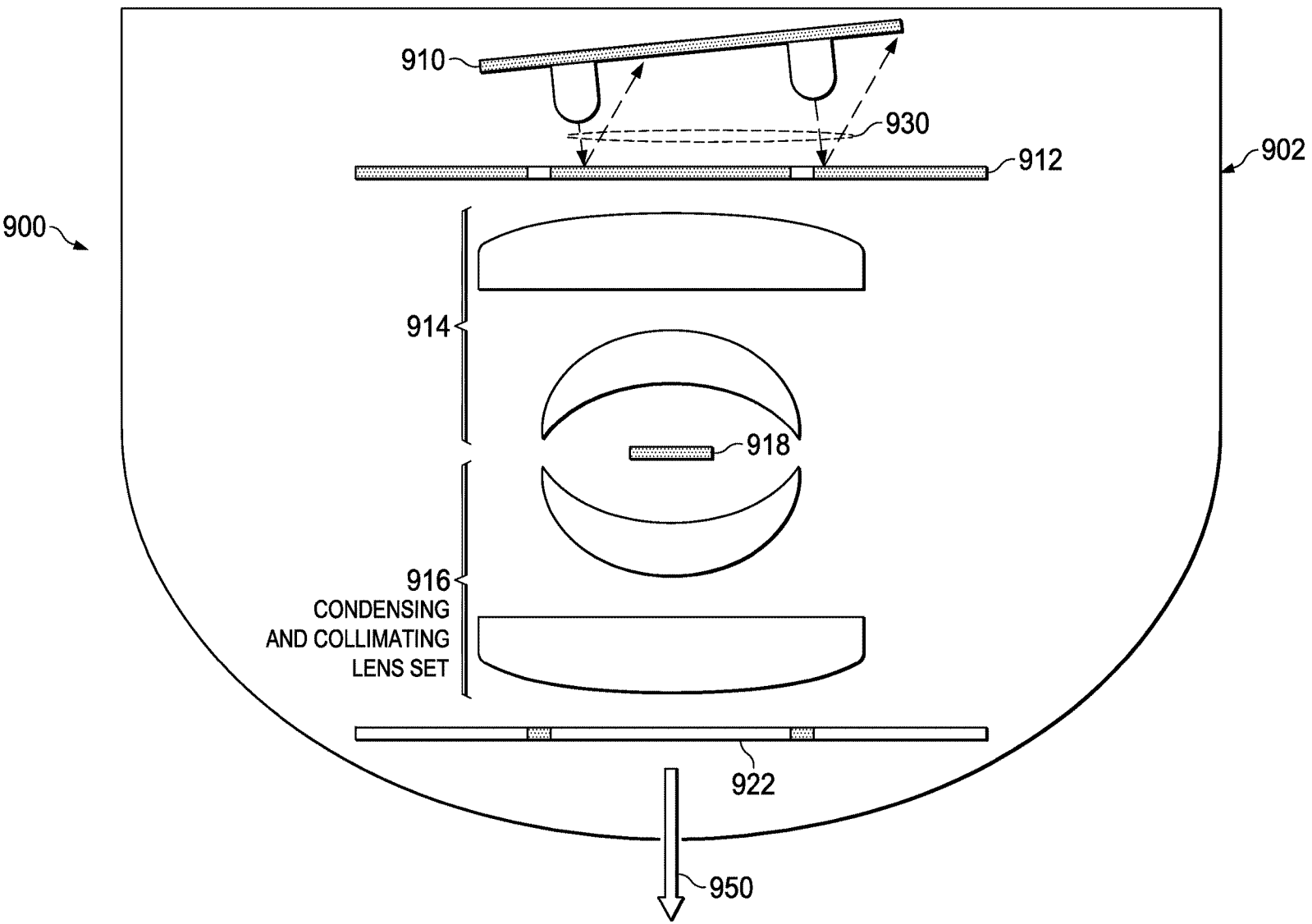
FIG. 9 depicts in a top view the intrinsically safe illumination system of FIG. 7 with an example shifted laser diode array failure.

FIG. 9 depicts in a top view an intrinsically safe illumination system 900 with an example shifted laser diode array failure. Depicted in FIG. 9 is an intrinsically safe illumination assembly 902 corresponding to the assembly 702 from FIG. 7. In FIG. 9, the numerical assignments from FIG. 7 are retained, only now in the 900 series. Assembly 902 includes the laser light source 910, the dichroic mirror 912, the condensing lens set 914, the dispersing element 918, collimating lens set 916, second dichroic mirror 922 and the final light output 950. In this example which is used to illustrate an intrinsically safe feature, the laser light source 910 is depicted as being shifted with respect to the dichroic mirror 912, so that the laser light 930 is no longer aligned with the aperture in the dichroic mirror 912. Since the dichroic mirror 912 reflects both blue and yellow light in the areas where the aperture is not located, the laser light is reflected back to the rear of the illumination system where it does not exit the lamp system. Because the laser light does not exit the assembly 902, this is an intrinsic safety feature of this arrangement and in sharp contrast to the prior known approaches, the intrinsically safe arrangements of the present application do not require any sensors, detectors, ECUs nor power interrupt systems to contain the laser beams.

Figure 10:
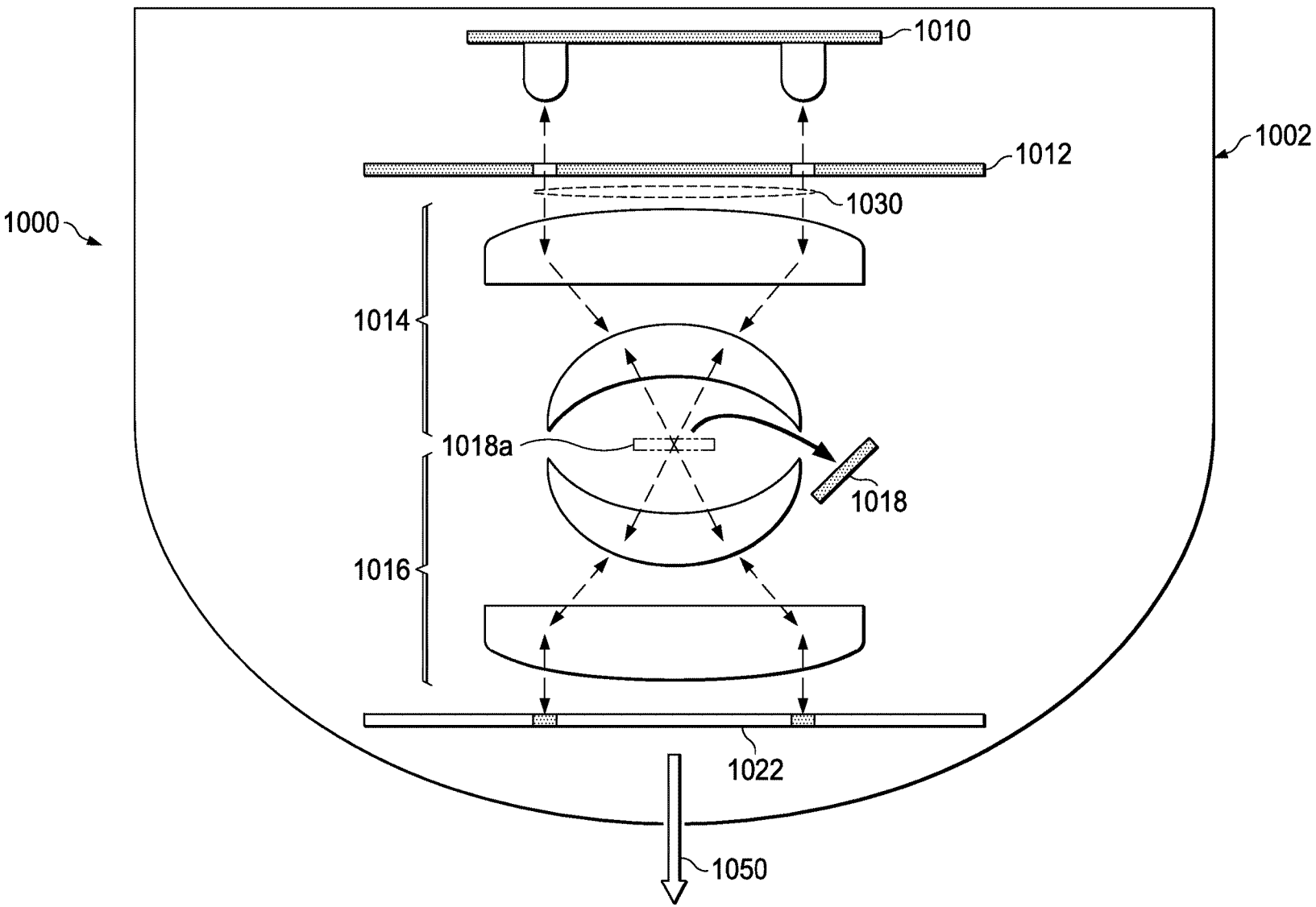
FIG. 10 depicts in another top view the intrinsically safe illumination system of FIG. 7 with an example phosphor coating failure.

FIG. 10 depicts in another example 1000 the intrinsically safe illumination system of FIG. 7 with a failed phosphor coating failure. Depicted in FIG. 10 is an intrinsically safe laser illumination system 1002 such as 702 from FIG. 7. In FIG. 10, the numerical assignments of FIG. 7 are retained, only in the 1000 series. Assembly 1002 includes the laser light source 1010, the dichroic mirror 1012, the condensing lens set 1014, dispersing element 1018, collimating lens set 1016, the second dichroic mirror 1022 and the final light output 1050. In this example used to illustrate an intrinsically safe feature, the yellow phosphor element 1018 has become dislodged, having moved from its original location 1018*a* to the example position 1018. Laser light 1030 retains its collimated composition since the phosphor element is no longer in place. The collimated laser light 1030 is considered dangerous and it should not exit the illumination system. In this failure example, the symmetric aperture nature of the reflective area on the second dichroic mirror 1022, simply reflects the laser light back into the lens sets 1016 and then 1014 where it passes thru dichroic mirror 1012 where it is contained within the illumination system 1002. The laser light does not exit the assembly 1002. This is an intrinsic safety feature of the arrangements of the present application, and unlike the prior known approaches, does not require any detectors, ECUs nor power interrupt systems to contain the laser beams. Thus the use of the novel arrangements of the present application provide an intrinsically safe laser illumination system.

Figure 11:
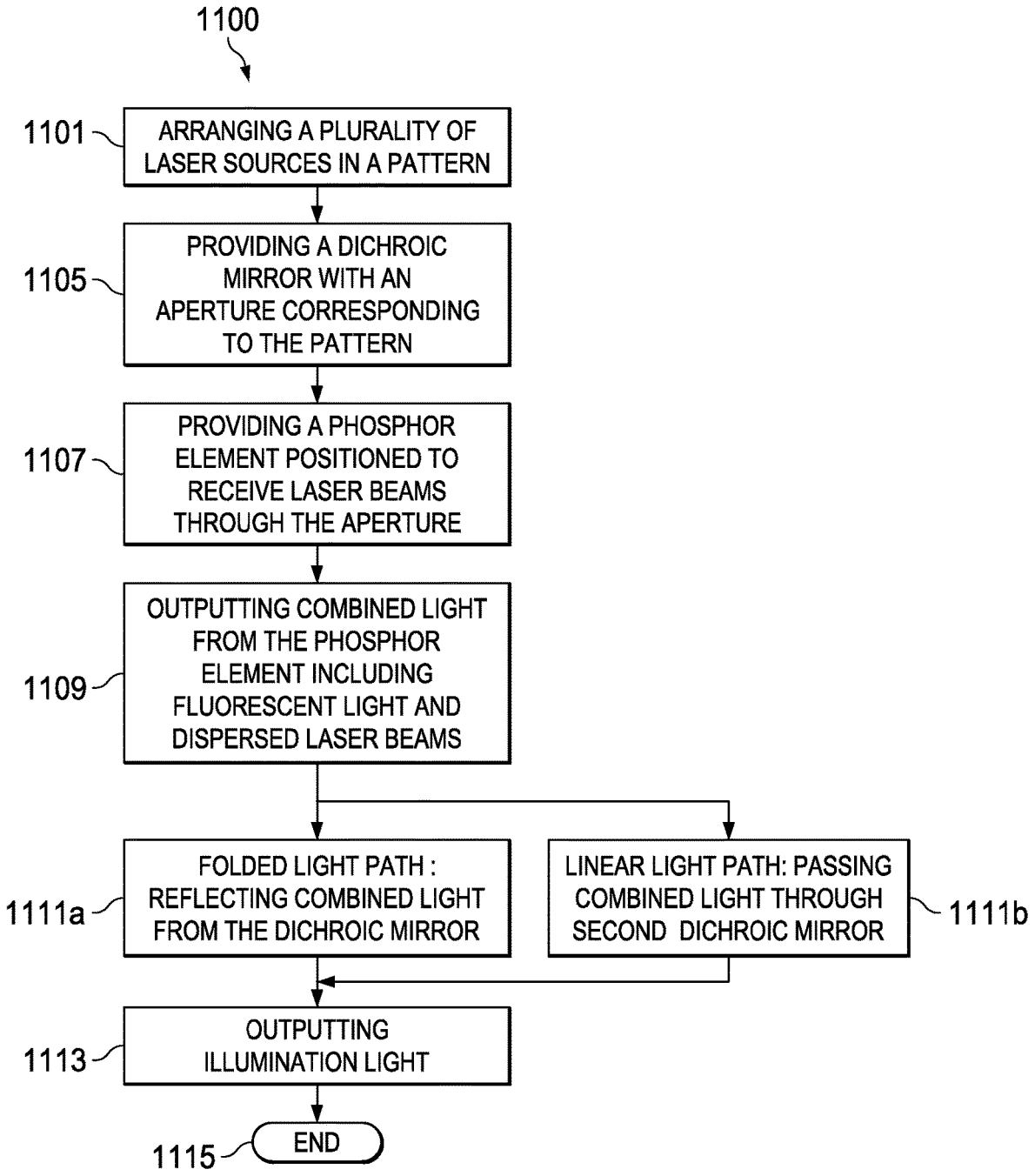
FIG. 11 depicts a flow diagram illustrating a method of creating an intrinsically safe illumination system.

FIG. 11 is a flow diagram illustrating an example method of creating an intrinsically safe illumination system. In FIG. 11, there are seven sequential steps illustrated in blocks 1101, 1105, 1107, 1109, 1111*a* or 1111*b*, 1113, and 1115. Step 1101 begins the method 1100 by arranging a plurality of laser sources in a pattern providing a symmetric laser light source, typically sourced from blue laser diodes, that produces laser light beams. At step 1105, a dichroic mirror is provided with an aperture that corresponds to the pattern of the laser sources. At step 1107, a phosphor element is provided positioned to receive laser beams from the laser sources through the aperture in the dichroic mirror. At step 1107, light is outputted from the phosphor including fluorescent light and dispersed laser light to form combined light. At step 1111*a*, in example arrangements such as illustrated in FIG. 2, the combined light is reflected from the dichroic mirror, but in some arrangements that have the output in line with the phosphor, such as shown in FIG. 7, step 1111*b* shows that the light will pass through a second dichroic mirror. In step 1113, the illumination light is output from the system.

The arrangements described herein can be incorporated into a laser source illumination headlight or headlamp. These headlights or headlamps can be used with a variety of vehicles including automotive and truck applications, marine applications, recreational applications such as snowmobiles, motocross, ATVs and the like, airplane and aerospace applications. The bright light provided by the use of the laser illumination sources is not limited to vehicular applications and can also be applied to outdoor lighting, portable lighting, spotlights, flashlights, and a variety of other lighting environments. Additional applications for lighting are also contemplated as benefitting from the use of the novel features of the arrangements.

Various modifications can also be made in the order of steps and in the number of steps to form additional novel arrangements that incorporate aspects of the present application, and these modifications will form additional alternative arrangements that are contemplated by the inventors as part of the present application and which fall within the scope of the appended claims.

Although the example illustrative arrangements have been described in detail, it should be understood that various changes, substitutions and alterations can be made herein without departing from the spirit and scope of the present application as defined by the appended claims.

Moreover, the scope of the present application is not intended to be limited to the particular illustrative example arrangement of the process, machine, manufacture, and composition of matter means, methods and steps described in this specification. As one of ordinary skill in the art will readily appreciate from the disclosure, processes, machines, manufacture, compositions of matter, means, methods or steps, presently existing or later to be developed, that perform substantially the same function or achieve substantially the same result as the corresponding example arrangements described herein may be utilized according to the illustrative arrangements presented and alternative arrangements described, suggested or disclosed. Accordingly, the appended claims are intended to include within their scope such processes, machines, manufacture, compositions of matter, means, methods, or steps.

What is claimed is:

1. A system comprising:

illumination sources configured to produce illuminated light having a first color;

a first dichroic mirror having a first surface portion and a second surface portion, the first surface portion configured to reflect light having the first color and to reflect light having a second color, and the second surface portion configured to transmit at least a portion of the illuminated light having the first color as transmitted light and to reflect light having the second color;

a phosphor element configured to produce fluorescent light having the second color responsive to receiving the transmitted light having the first color, and to disperse a portion of the transmitted light, to produce dispersed light having the first color; and a second dichroic mirror having a third surface portion and a fourth surface portion, the phosphor element optically coupled between the first dichroic mirror and the second dichroic mirror, the third surface portion configured to reflect the dispersed light of the first color, and the fourth surface portion configured to transmit at least a portion of the fluorescent light of the second color and to transmit light of the first color.

2. The system of claim 1, wherein the illumination sources include laser diodes.

3. The system of claim 2, wherein the laser diodes are configured to output blue light or violet light.

4. The system of claim 2, wherein the laser diodes are configured to output light having a wavelength between 400 nanometers and 460 nanometers.

5. The system of claim 1, wherein the second color is yellow.

6. The system of claim 5, wherein the phosphor element is configured to not reflect the illuminated light responsive to the phosphor element being displaced from its original position.

7. The system of claim 1, wherein a substrate of the phosphor element is configured to reflect the illuminated light back to the second surface portion, responsive to a phosphor coating on the phosphor element being dislocated.

8. The system of claim 1, wherein the illumination sources are configured to transmit the illuminated light to strike the first surface portion, responsive to the illumination sources being displaced from their original position.

9. The system of claim 1, wherein the first color is blue, and the second color is yellow.

10. The system of claim 1, further comprising:

a condensing lens optically coupled between the first dichroic mirror and the phosphor element; and a collimating lens optically coupled between the phosphor element and the second dichroic mirror.

11. The system of claim 1, the second surface portion having an inner edge and an outer edge, the outer edge having an oval shape, a circular shape, a rectangular shape, or a square shape.

12. A method, comprising:

producing, by illumination sources, illuminated light having a first color;

reflecting, by a first surface portion of a first dichroic mirror, the illuminated light having the first color, the first surface portion configured to reflect light having a second color;

transmitting, by a second surface portion of the first dichroic mirror, at least a portion of the illuminated light having the first color as transmitted light, the second surface portion configured to reflect light having the second color;

producing, by a phosphor element, fluorescent light having the second color, responsive to receiving the transmitted light;

dispersing, by the phosphor element, a portion of the transmitted light, to produce dispersed light having the first color;

reflecting, by a third surface portion of a second dichroic mirror, the dispersed light of the first color; and transmitting, by a fourth surface portion of the second dichroic mirror, at least a portion of the fluorescent light, wherein the fourth surface portion is configured to transmit light having the first color.

13. The method of claim 12, wherein when the illumination sources are dislocated, the illuminated light strikes the first surface portion.

14. The method of claim 12, wherein when the phosphor element loses a phosphor coating, a substrate of the phosphor element is configured to reflect the illuminated light back to the second surface portion.

15. The method of claim 12, wherein the first color is blue and the second color is yellow.

16. The method of claim 12, further comprising:

focusing, by a condensing lens, the illuminated light on the phosphor element; and collimating, by a collimated lens, the fluorescent light and the dispersed light.

17. A headlight comprising:

laser diodes configured to produce illuminated light having a first color;

a first dichroic mirror having a first surface portion and a second surface portion, the first surface portion configured to reflect light having the first color and to reflect light having a second color, the second surface portion configured to transmit at least a portion of the illuminated light having the first color as transmitted light and to reflect light having the second color;

a phosphor element configured to produce fluorescent light having the second color responsive to receiving the transmitted light having the first color and to disperse a portion of the transmitted light to produce dispersed light having the first color;

a second dichroic mirror having a third surface portion and a fourth surface portion, the phosphor element optically coupled between the first dichroic mirror and the second dichroic mirror, the third surface portion configured to reflect light of the first color, and the fourth surface portion configured to transmit light of the first color and to transmit at least a portion of the fluorescent light of the second color;

a condensing lens optically coupled between the first dichroic mirror and the phosphor element; and a collimating lens optically coupled between the phosphor element and the second dichroic mirror.

18. The headlight of claim 17, wherein a substrate of the phosphor element is configured to reflect the illuminated light back through the second surface portion, responsive to the phosphor element losing a phosphor coating.

19. The headlight of claim 17, wherein the first color is blue and the second color is yellow.

20. The headlight of claim 17, the second surface portion having an inner edge and an outer edge, the outer edge having an oval shape, a circular shape, a rectangular shape, or a square shape.

* * * * *